US007833407B2

(12) United States Patent
Brons et al.

(10) Patent No.: US 7,833,407 B2
(45) Date of Patent: Nov. 16, 2010

(54) METHOD OF BLENDING HIGH TAN AND HIGH $S_{BN}$ CRUDE OILS AND METHOD OF REDUCING PARTICULATE INDUCED WHOLE CRUDE OIL FOULING AND ASPHALTENE INDUCED WHOLE CRUDE OIL FOULING

(75) Inventors: Glen B. Brons, Phillipsburg, NJ (US); Chris A. Wright, Bordentown, NJ (US); George A. Lutz, Brick, NJ (US); Daniel P. Leta, Flemington, NJ (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 652 days.

(21) Appl. No.: 11/506,901

(22) Filed: Aug. 21, 2006

(65) Prior Publication Data

US 2008/0041762 A1 Feb. 21, 2008

(51) Int. Cl.
*C10G 71/00* (2006.01)

(52) U.S. Cl. ..... 208/48 R; 208/14; 208/48 AA

(58) Field of Classification Search ..... 208/18–19, 208/48 R

See application file for complete search history.

(56) References Cited

U.S. PATENT DOCUMENTS

| | | | | |
|---|---|---|---|---|
| 4,853,337 | A | 8/1989 | Dickakian | |
| 5,863,415 | A * | 1/1999 | Zetlmeisl | 208/47 |
| 5,871,634 | A | 2/1999 | Wiehe | |
| 5,997,723 | A | 12/1999 | Wiehe | |
| 6,048,904 | A | 4/2000 | Wiehe et al. | |
| 6,355,159 | B1 | 3/2002 | Myers | |
| 6,706,669 | B2 | 3/2004 | Sartori et al. | |
| 2004/0072361 | A1 | 4/2004 | Varadaraj et al. | |
| 2004/0121472 | A1 | 6/2004 | Nemana | |
| 2006/0021907 | A1 | 2/2006 | Varadaraj et al. | |
| 2006/0042661 | A1 * | 3/2006 | Meyer et al. | 134/22.14 |
| 2006/0219266 | A1 | 10/2006 | Meyer | |

OTHER PUBLICATIONS

The Oil Compatibility Model and Crude Oil Incompatibility, Wiehe and Kennedy, Energy & Fuels 2000, vol. 14, pp. 56-59, published Dec. 14, 1999.

Wiehe, Irwin A.,"Fouling of Nearly Incompatible Oils", American Chemical Society, Journal, Energy & Fuels (2001), 15 (5), 1057-1058.

Wiehe, Irwin A., "Prevention of Fouling by Incompatible Crudes With The [Crude] Oil Compatibility Model", AlChE 1999 Spring National Meeting (Houston Mar. 14-18, 1999) Preprint N. 9.

(Continued)

*Primary Examiner*—Robert J Hill, Jr.
*Assistant Examiner*—Brian McCaig
(74) *Attorney, Agent, or Firm*—Glenn T. Barrett

(57) ABSTRACT

A high solvency dispersive power (HSDP) crude oil is added to a blend of incompatible oils to proactively address the potential for fouling heat exchange equipment. The HSDP component dissolves asphaltene precipitates and maintains suspension of inorganic particulates before coking affects heat exchange surfaces. An HSDP oil is also flushed through heat exchange equipment to remove any deposits and/or precipitates on a regular maintenance schedule before coking can affect heat exchange surfaces.

8 Claims, 10 Drawing Sheets

OTHER PUBLICATIONS

International Search Report, PCT/US2007/018403, mailed Sep. 25, 2008.

Written Report, PCT/US2007/018403, mailed Sep. 25, 2008.

Carnahan, Norman F., "Properties of Resins Extracted From Boscan Crude Oil and Their Effect on the Stability of Asphaltenes in Boscan and Hamaca Crude Oils", Energy & Fuels, 1999, pp. 309-314, vol. 980218.

PCT International Search Report, Form PCT/ISA/210, mailed Nov. 27, 2009, 4pgs.

PCT Written Opinion of the ISA, Form PCT/ISA/237, mailed Nov. 27, 2009, 7pgs.

* cited by examiner

METHOD OF BLENDING HIGH TAN AND HIGH $S_{BN}$ CRUDE OILS AND METHOD OF REDUCING PARTICULATE INDUCED WHOLE CRUDE OIL FOULING AND ASPHALTENE INDUCED WHOLE CRUDE OIL FOULING

BACKGROUND OF THE INVENTION

1. Field of the Invention

The present invention relates to processing of whole crude oils, blends and fractions in refineries and petrochemical plants. In particular, the present invention relates to the reduction of particulate induced crude oil fouling and asphaltene induced crude oil fouling. The present invention relates to the blending of high total acid number (TAN) and high solubility blending number ($S_{BN}$) crude oils to reduce fouling in pre-heat train exchangers, furnaces, and other refinery process units.

2. Discussion of Related Art

Fouling is generally defined as the accumulation of unwanted materials on the surfaces of processing equipment. In petroleum processing, fouling is the accumulation of unwanted hydrocarbon-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers. Second, as deposition occurs, the cross-sectional area is reduced, which causes an increase in pressure drop across the apparatus and creates inefficient pressure and flow in the heat exchanger.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall. For example, the inventors have shown that a low-sulfur, low asphaltene (LSLA) crude oil and a high-sulfur, high asphaltene (HSHA) crude blend are subject to a significant increase in fouling when in the presence of iron oxide (rust) particulates, as shown for example in FIGS. 1 and 2.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Another common cause of rapid fouling is attributed to the presence of salts and particulates. Salts/particulates can precipitate from the crude oils and adhere to the hot surfaces of the heat exchanger. Inorganic contaminants play both an initiating and promoting role in the fouling of whole crude oils and blends. Iron oxide, calcium carbonate, silica, sodium and calcium chlorides have all been found to be attached directly to the surface of fouled heater rods and throughout the coke deposit.

Prolonged exposure to such surface temperatures, especially in the late-train exchanger, allows for the thermal degradation of the organics and asphaltenes to coke. The coke then acts as an insulator and is responsible for heat transfer efficiency losses in the heat exchanger by preventing the surface from heating the oil passing through the unit. Salts, sediment and particulates have been shown to play a major role in the fouling of pre-heat train heat exchangers, furnaces and other downstream units. Desalter units are still the only opportunity refineries have to remove such contaminants and inefficiencies often result from the carryover of such materials with the crude oil feeds.

Blending of oils in refineries is common, but certain blends are incompatible and cause precipitation of asphaltenes that can rapidly foul process equipment. Improper mixing of crude oils can produce asphaltenic sediment that is known to reduce heat transfer efficiency. Although most blends of unprocessed crude oils are not potentially incompatible, once an incompatible blend is obtained, the rapid fouling and coking that results usually requires shutting down the refining process in a short time. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils, blends and fractions in pre-heat train exchangers.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

The need exists to be able to prevent the precipitation/adherance of particulates and asphaltenes from the heated surfaces before the particulates can promote fouling and the asphaltenes become thermally degraded or coked. The coking mechanism requires both temperature and time. The time factor can be greatly reduced by keeping the particulates away from the surface and by keeping the asphaltenes in solution. Such reduction and/or elimination of fouling will lead to increased run lengths (less cleaning), improved performance and energy efficiency while also reducing the need for costly fouling mitigation options.

Some refineries and crude schedulers currently follow blending guidelines to minimize asphaltene precipitation and the resultant fouling of pre-heat train equipment. Such guidelines suggest blending crude oils to achieve a certain relationship between the solubility blending number ($S_{BN}$) (also symbolized by $S_{BN}$) and insolubility number ($I_n$) of the blend. The $S_{BN}$ is a parameter relating to the compatibility of an oil with different proportions of a model solvent mixture, such as toluene/n-heptane. The $S_{BN}$ is related to the $I_n$, which is determined in a similar manner, as described in U.S. Pat. No. 5,871,634, which is incorporated herein by reference. Some blending guidelines suggest a $S_{BN}/I_n$ blend ratio >1.3 and a delta ($S_{BN}-I_n$)>10 to minimize asphaltene precipitation and fouling. However, these blends are designed for use as a passive approach to minimizing asphaltene precipitation.

Attempts have been made to improve the method of blending two or more petroleum oils that are potentially incompatible while maintaining compatibility to prevent the fouling and coking of refinery equipment. U.S. Pat. No. 5,871,634 discloses a method of blending that includes determining the insolubility number ($I_n$) for each feedstream and determining the solubility blending number ($S_{BN}$) for each stream and combining the feedstreams such that the $S_{BN}$ of the mixture is greater than the $I_n$ of any component of the mix. In another method, U.S. Pat. No. 5,997,723 uses a blending method in which petroleum oils are combined in certain proportions in order to keep the $S_{BN}$ of the mixture higher than 1.4 times the $I_n$ of any oil in the mixture.

These blends do not minimize both fouling associated with asphaltene and particulate induced/promoted fouling. There is a need for developing a proactive approach to addressing organic, inorganic and asphaltene precipitation and thereby minimize the associated foulant deposition and/or build up.

BRIEF SUMMARY OF THE INVENTION

It is an aspect of the present invention to provide a method for reducing fouling associated with the processing of crude oil in a refinery. It is desirable to reduce and/or mitigate fouling in heat exchangers. While the present invention is described in connection with heat exchangers, the present invention is not intended to be limited to heat exchangers; rather, it is contemplated that the present invention is applicable to other components (including but not limited to pipestills, cokers, visbreakers, and the like) that are capable of experiencing fouling conditions associated with either particulate fouling and/or asphaltene fouling. Of course, it is possible to apply the invention to other processing facilities and heat exchangers, particularly those that are susceptible to fouling in a similar manner as experienced during refining processes and are inconvenient to take off line for repair and cleaning. One method associated with the present invention includes blending a base crude oil with a predetermined amount of a high solvency dispersive power (HSDP) crude oil. The addition of HSDP crude oil has been found to be effective in mitigating both asphaltene induced fouling and particulate induced/promoted fouling. The base crude oil may consist of a whole crude oil, a blend of two or more crude oils or fractions thereof. The HSDP crude oil has a total acid number (TAN) of at least 0.3. It is contemplated that various crude oils can be used as the HSDP crude oil including but not limited to the examples described herein. Other HSDP crude oils are considered to be within the scope of the present invention and suitable for blending with the base crude oil provided such HSDP crude oil has a TAN of at least 0.3. Preferably, the TAN for the HSDP crude oil is at least 0.5. More preferably, the TAN for the HSDP crude oil is at least 1.0. It is contemplated that the TAN for the HSDP crude oil may exceed 4. It has also been determined that the most effective HSDP crude oils have higher molecular weights (e.g. wt. avg.). The blended crude oil is processed within the refinery with significant reductions in fouling. As such, the efficiency of the refinery operations is enhanced.

In accordance with the present invention, the predetermined amount of HSDP crude oil is equal to at least five percent of the total volume of the blended base crude and HSDP crude oil. HSDP crude oil may make up at least ten percent of the total volume of the blended base crude and the HSDP crude. HSDP crude oil may make up at least twenty five percent of the total volume of the blended base crude and the HSDP crude. It is preferable that the content of HSDP crude oil not exceed fifty percent of the total volume of the blended base crude and the HSDP crude oil.

In accordance with the present invention for purposes of mitigating fouling, the HSDP crude oil should have a solubility blending number ($S_{BN}$) of at least 75. It is preferable that the $S_{BN}$ is at least 100. It is more preferable that the $S_{BN}$ is at least 100.

It is another aspect of the present invention to provide a method of reducing fouling in a heat exchanger. The method includes blending a base crude oil with a predetermined amount of a HSDP crude oil. The base crude oil may consist of a whole crude oil, a blend of two or more crude oils or fractions thereof. The HSDP crude oil has $S_{BN}$ of at least 85. It is preferable that the $S_{BN}$ is at least 100. It is more preferable that the $S_{BN}$ is at least 110. The predetermined amount of HSDP crude oil is equal to at least five percent to at most fifty percent of the total volume of the blended base crude and HSDP crude oil.

It is another aspect of the present invention to a blended crude oil that is capable of reducing and mitigating both asphaltene induced fouling and particulate induced fouling and/or promotion in refinery components, including but not limited to heat exchangers and the like. The blended crude includes a base crude oil and a HSDP crude oil. The HSDP crude oil has a TAN of at least 0.3. The HSDP crude oil makes up at least 5 percent of the total volume of the blended crude. It is contemplated that various crude oils can be used as the HSDP crude oil. Other HSDP crude oils are considered to be within the scope of the present invention and suitable for blending with the base crude oil provided such HSDP crude oil has a TAN of at least 0.3. Preferably, the TAN for the HSDP crude oil is at least 0.5. More preferably, the TAN for the HSDP crude oil is at least 1.0. It is contemplated that the TAN for the HSDP crude oil may exceed 4. In accordance with the present invention, it is preferable that the HSDP crude oil has a $S_{BN}$ of at least 75. It is more preferable that the $S_{BN}$ is at least 100. It is more preferable that the $S_{BN}$ is at least 110.

The volume of HSDP crude oil necessary in the blended crude oil will vary based upon the TAN and/or $S_{BN}$ values of the HSDP crude oil. The higher TAN and/or $S_{BN}$ values of the HSDP crude oil, the lower the volume of HSDP crude oil necessary to produce a blended crude oil that will reduce and/or mitigate both asphaltene induced fouling and particulate induced fouling and/or promotion in refinery components, including but not limited to heat exchangers and the like. The HSDP crude oil preferably makes up between five percent and fifty percent of the total volume of the blended crude oil.

The inventors have determined that the reductions in fouling associated with the present invention are due to prevention and are not the result of an in-situ foulant-formation and removal mechanism. These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

The present invention will now be described in greater detail in connection with the figures. The present invention aims to reduce fouling in heat exchangers and other components located within a refinery. This aim is achieved by a blended base crude oil, which may consist of a whole crude oil, a blend of two or more crude oils or fractions thereof with a predetermined amount of a high solvency dispersive power (HSDP) crude oil. The addition of HSDP crude oil mitigates both asphaltene induced fouling and particulate induced/promoted fouling. The high Sbn of these HSDP crude oils allows for the enhanced solubility of any asphaltenes in the rest of the crude oils and/or blends. The presence of TAN is believed to help disperse the particulates in the crude oil blend which prevents them from adhering to the heated surface. In order to achieve the reduction in fouling, the HSDP crude oil should have a total acid number (TAN) of at least 0.3. Higher TAN levels may result in improved fouling reduction and mitigation. The HSDP crude oil should have a solubility blending number ($S_{BN}$) of at least 75. Higher $S_{BN}$ levels may result in improved fouling reduction and mitigation. The volume of HSDP crude oil necessary in the blended crude oil will vary based upon the TAN and/or $S_{BN}$ values of the HSDP crude oil. The higher TAN and/or $S_{BN}$ values of the HSDP crude oil, the lower the volume of HSDP crude oil necessary to produce a blended crude oil that will reduce and/or mitigate both asphaltene induced fouling and particulate induced fouling and/or promotion in refinery components, including but not limited to heat exchangers and the like. The HSDP crude oil preferably makes up between five percent and fifty percent of the total volume of the blended crude oil.

The blended crude oil is then processed within the refinery. The blended crude oil exhibits improved characteristics over the base crude oil. Specifically, the blended crude oil exhibits a significant reduction in fouling over base crude which contain particulates. This results in improved heat transfer within the heat exchanger and a reduction in overall energy consumption.

Figure 10:
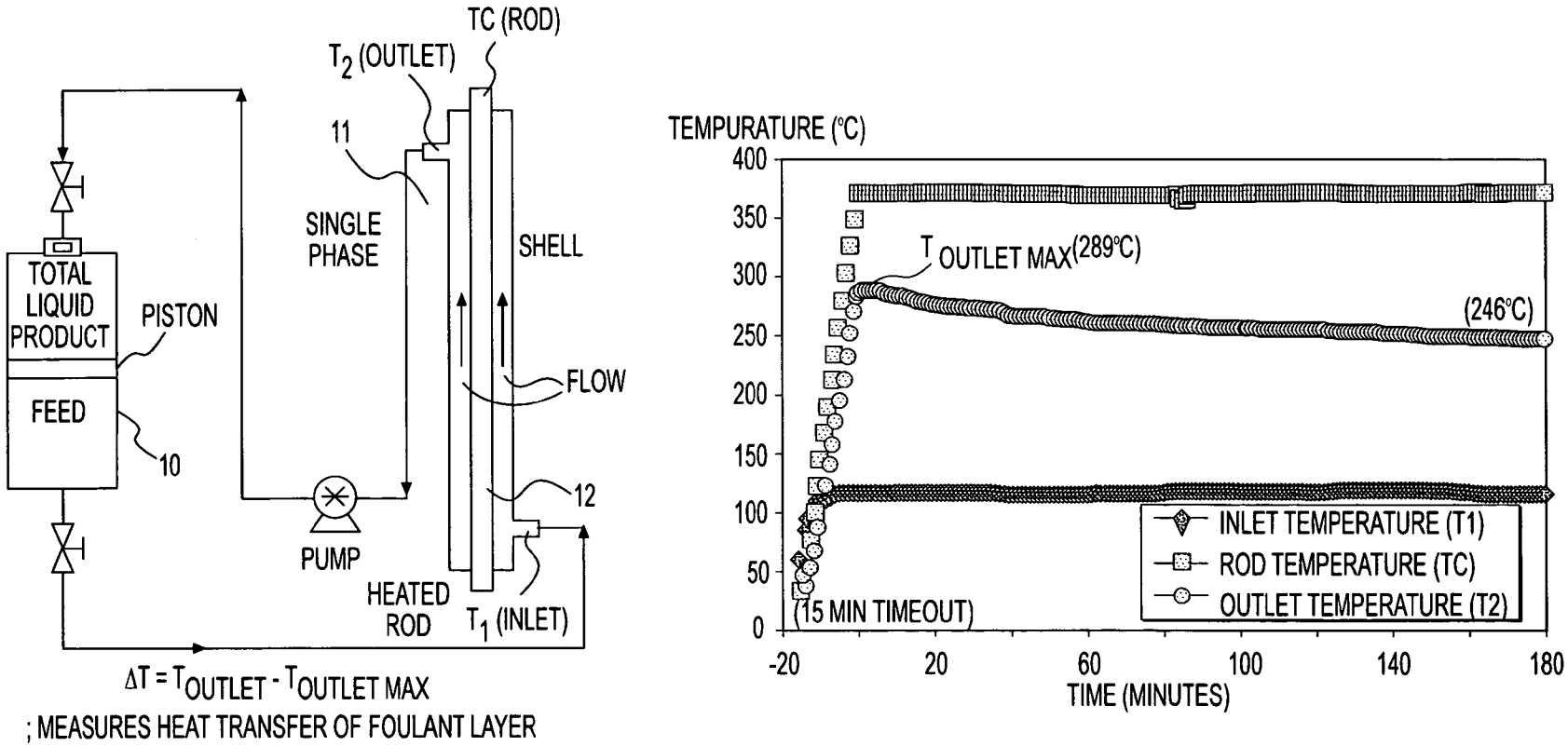
FIG. 10 is a schematic of an Alcor fouling simulator used in accordance with the present invention.

FIG. 10 depicts an Alcor testing arrangement used to measure what the impact the addition of particulates to a crude oil has on fouling and what impact the addition of a HSDP crude oil has on the reduction and mitigation of fouling. The testing arrangement includes a reservoir 10 containing a feed supply of crude oil. The feed supply of crude oil may contain a base crude oil containing a whole crude or a blended crude containing two or more crude oils. The feed supply may also contain a HSDP crude oil. The feed supply is heated to a temperature of approximately 150° C./302° F. and then fed into a shell 11 containing a vertically oriented heated rod 12. The heated rod 12 may be formed from a carbon steel. The heated rod 12 simulates a tube in a heat exchanger. The heated rod 12 is electrically heated to a predetermined temperature and maintained at such predetermined temperature during the trial. Typically rod surface temperatures are approximately 370° C./698° F. and 400° C./752° F. The feed supply is pumped across the heated rod 12 at a flow rate of approximately 3.0 mL/minute. The spent feed supply is collected in the top section of the reservoir 10. The spent feed supply is separated from the untreated feed supply oil by a sealed piston, thereby allowing for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface. The foulant deposits are thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid ΔT or dT and can be dependent on the type of crude oil/blend, testing conditions and/or other effects, such as the presence of salts, sediment or other fouling promoting materials. A standard Alcor fouling test is carried out for 180 minutes. The total fouling, as measured by the total reduction in outlet liquid temperature is referred to as ΔT180 or dT180.

Figure 1:
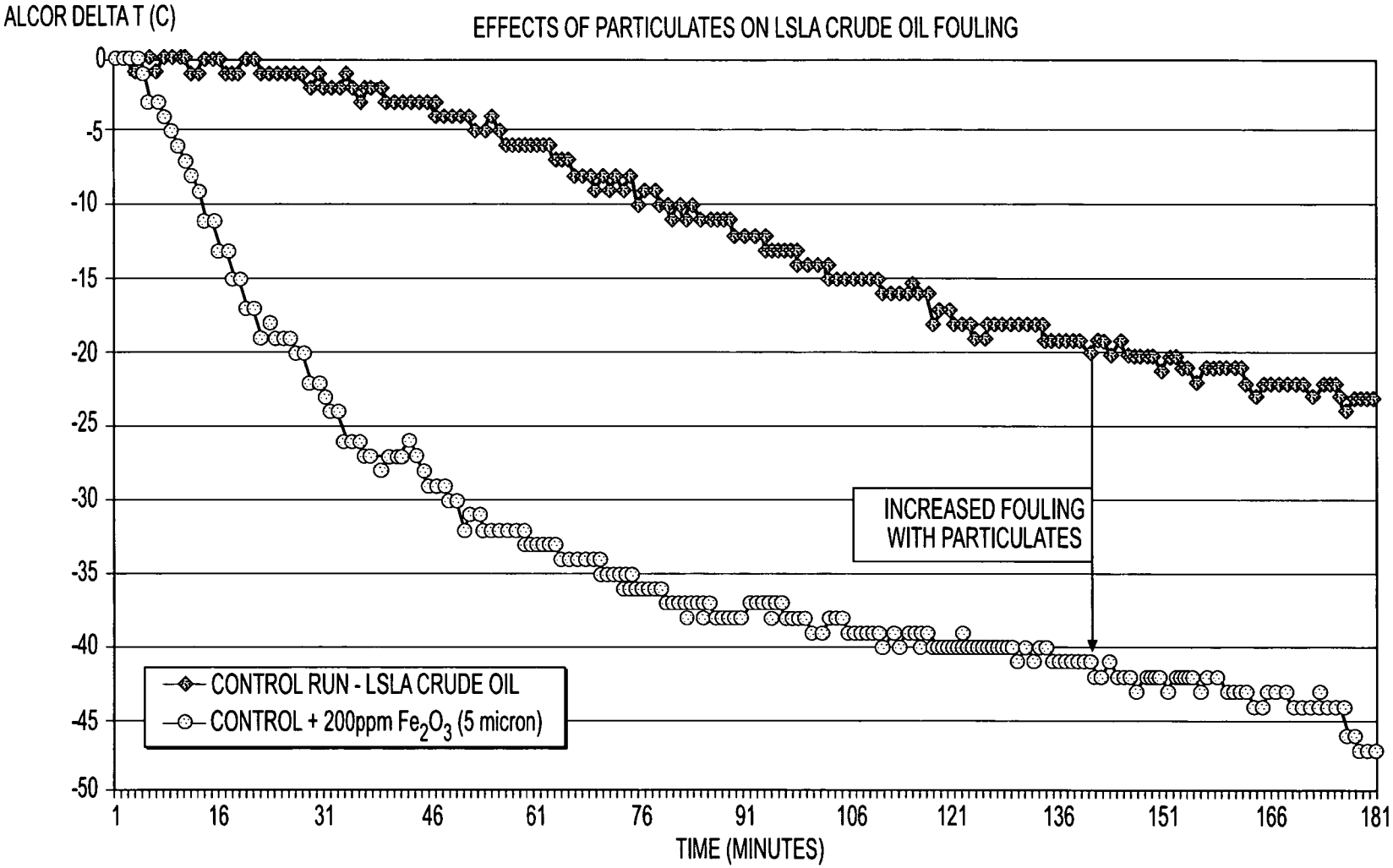
FIG. 1 is a graph illustrating the effects of particulates on fouling of a LSLA crude oil.
Figure 2:
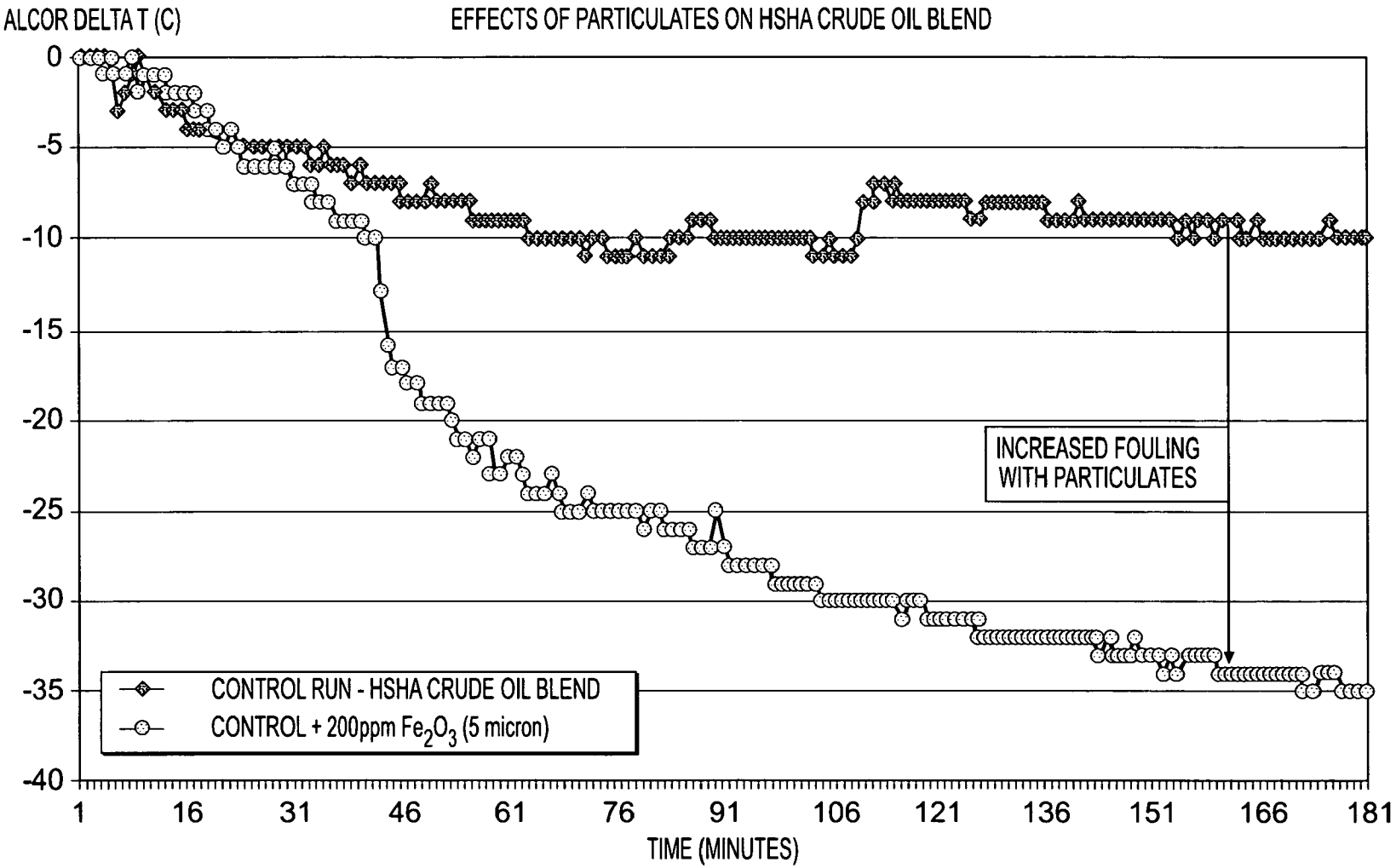
FIG. 2 is a graph illustrating the effects of particulates on fouling of a HSHA crude oil blend.

FIG. 1 and FIG. 2. illustrate the impact that the presence of particulates in a crude oil has on fouling of a refinery component or unit. There is an increase in fouling in the presence of iron oxide ($Fe_2O_3$) particles when compared to similar crude oils which that do not contain particulates. The present invention will be described in connection with the use of a low-sulfur, low asphaltene or LSLA whole crude oil and a high-sulfur, high asphaltene or HSHA crude oil blend as base crude oil examples. These oils were selected as being representative of certain classifications of crude oil. The LSLA crude oil represents a low $S_{BN}$, high reactive sulfur and low asphaltenes crude oil. The HSHA blend crude oil represents a crude oil that is both high in asphaltenes and reactive sulfur. The use of these crude oils is for illustrative purposes only, the present invention is not intended to be limited to application only with LSLA crude oil and HSHA crude oil. It is intended that the present invention has application with all whole and blended crude oils and formulations of the same that experience and/or produce fouling in refinery components including but not limited to heat exchangers. The presence of fouling reduces the heat transfer of the heating tubes or rods contained within a heat exchanger. As described above, the presence of fouling has an adverse impact of heat exchanger performance and efficiency.

The present inventors have found that the addition of a crude oil having a high TAN and/or high $S_{BN}$ to the base crude oil reduces particulate-induced fouling. The degree of fouling reduction appears to be a function of the TAN level in the overall blend. This is believed to be due to the ability of the naphthenic acids to keep particulates present in the blends from wetting and adhering to the heated surface, where otherwise promoted and accelerated fouling/coking occur. Most high TAN crudes oils also have very high $S_{BN}$ levels, which have been shown to aid in dissolving asphaltenes and/or keeping them in solution more effectively which also reduces fouling that would otherwise occur due to the incompatibility and near-incompatibility of crude oils and blends. These crude oils are classified as high solvency dispersive power (HSDP) crude oils. There is a notable reduction in fouling when a predetermined amount of HSDP crude oil is added to the base crude, where the HSDP crude oil has a TAN as low as 0.3 and a $S_{BN}$ as low as 75. The predetermined amount of HSDP crude oil may make up as low as five percent (5%) of the total volume of the blended crude oil (i.e., base crude oil+HSDP crude oil).

Figure 3:
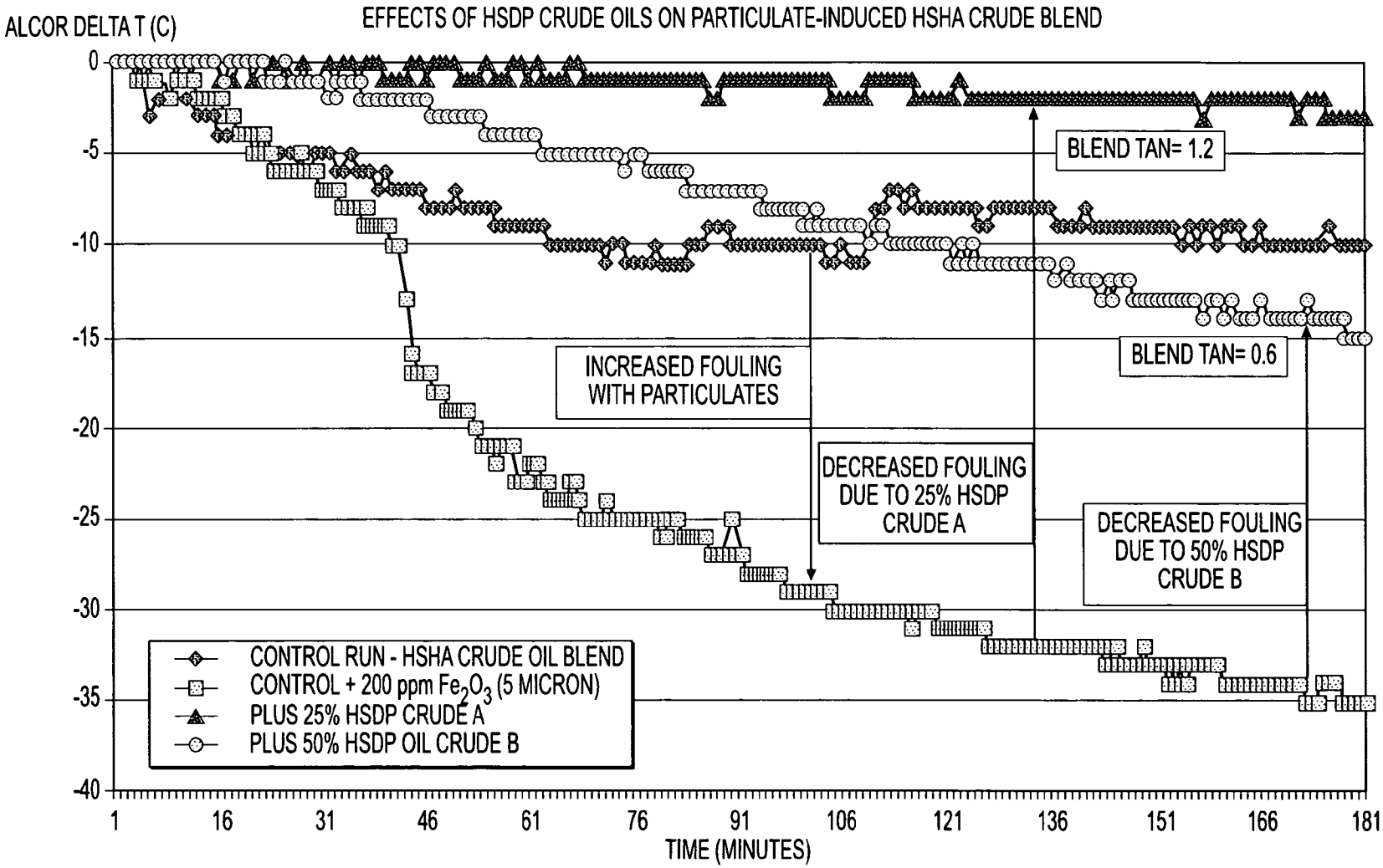
FIG. 3 is a graph illustrating test results showing reduced fouling associated with a HSHA crude oil blend when blended with a HSDP Crude Oil in accordance with this invention.

Sample tests were performed to determine the effect the addition of HSDP Crude Oils A and/or B to a HSHA base crude oil has on the fouling of the base oil. The results are illustrated in FIG. 3. FIG. 3 is a variation of FIG. 2 where the reduction in fouling associated with the addition of a predetermined amount of HSDP crude is blended with a base crude oil containing the HSHA crude oil. In one example, the base crude oil containing HSHA is blended with a HSDP crude oil, which accounts for twenty five percent (25%) of the total volume of the blended crude oil. The HSDP crude oil is labeled HSDP crude oil A having an approximate TAN of 4.8 and a $S_{BN}$ of 112. As shown in FIG. 3, a significant reduction is fouling is achieved when compared to both base crude oil containing particulates and a base oil without particulates. In another example, the base crude oil containing HSHA is blended with a HSDP crude oil, which accounts for fifty percent (50%) of the total volume of the blended crude oil. The HSDP crude oil is HSDP Crude Oil B having an approximate TAN of 1.1 and a $S_{BN}$ of 115. While the impact of the HSDP Crude Oil B on the fouling of the base crude oil is not as significant as the HSDP Crude Oil A, the HSDP Crude Oil B nonetheless produces a marked decrease in the fouling of a base crude oil containing particulates.

Figure 4:
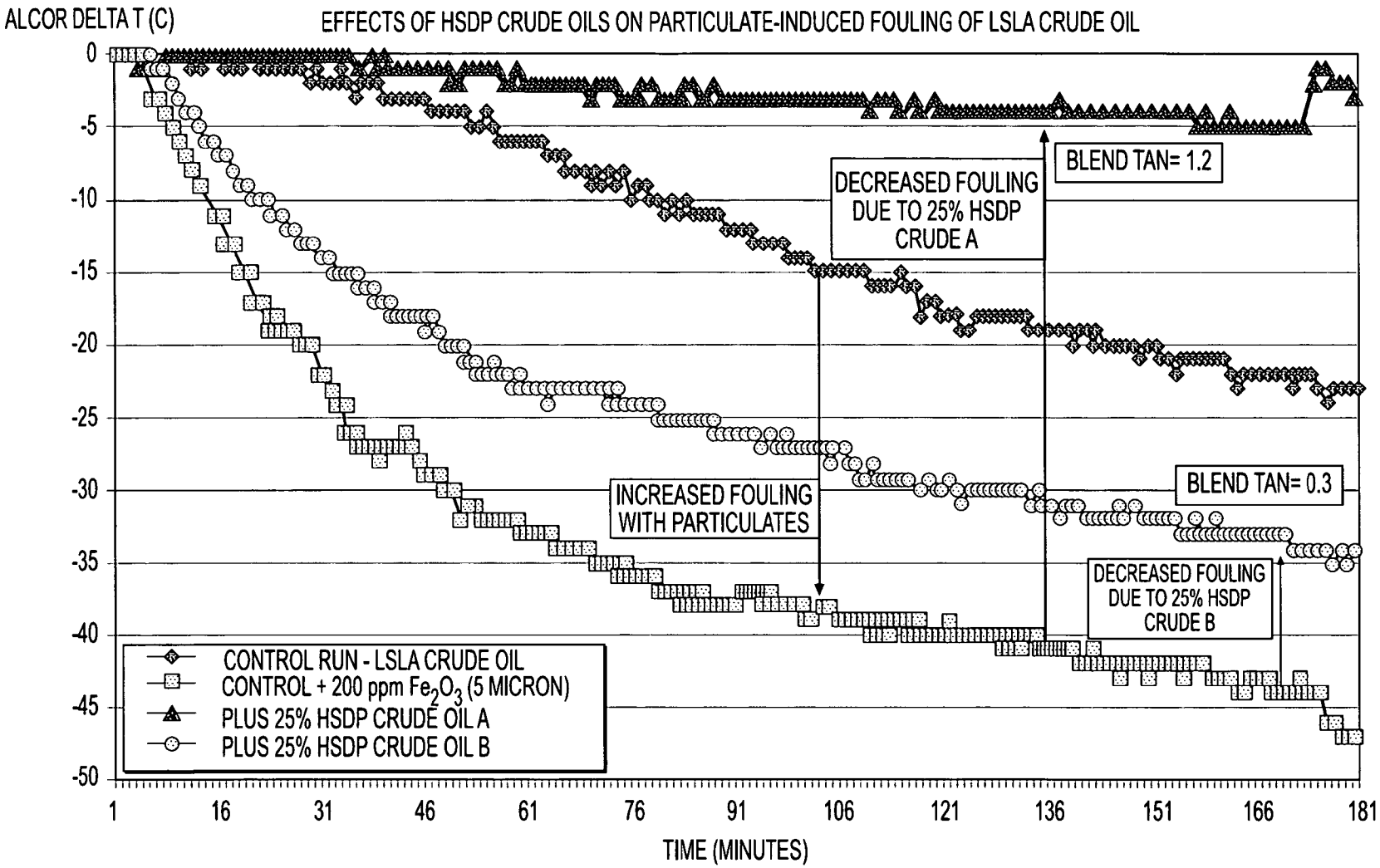
FIG. 4 is a graph illustrating test results showing reduced fouling associated with a LSLA crude oil when blended with a HSDP Crude Oil in accordance with this invention.

Sample tests were performed to determine the effect the addition of HSDP Crude Oils A and B on the fouling of the base oil. The results are illustrated in FIG. 4. FIG. 4 is a variation of FIG. 1 where the reduction in fouling associated with the addition of a predetermined amount of HSDP crude is blended with a base crude oil. In the illustrated examples, the base crude oil is a LSLA crude oil and is blended with HSDP Crude Oil A, which accounts for twenty five percent (25%) of the total volume of the blended crude oil. Like the addition of HSDP Crude Oil A to the HSHA crude oil, a significant reduction is fouling is achieved when compared to both base crude oil containing particulates and a base oil without particulates. In the other illustrated example, the LSLA base crude oil is blended with HSDP Crude Oil B, which accounts for fifty percent (50%) of the total volume of the blended crude oil. While the impact of the HSDP Crude Oil B on the fouling of the base crude oil is not as significant as the HSDP Crude Oil A, the HSDP Crude Oil B again produces a marked decrease in the fouling of a base crude oil containing particulates.

Figure 5:
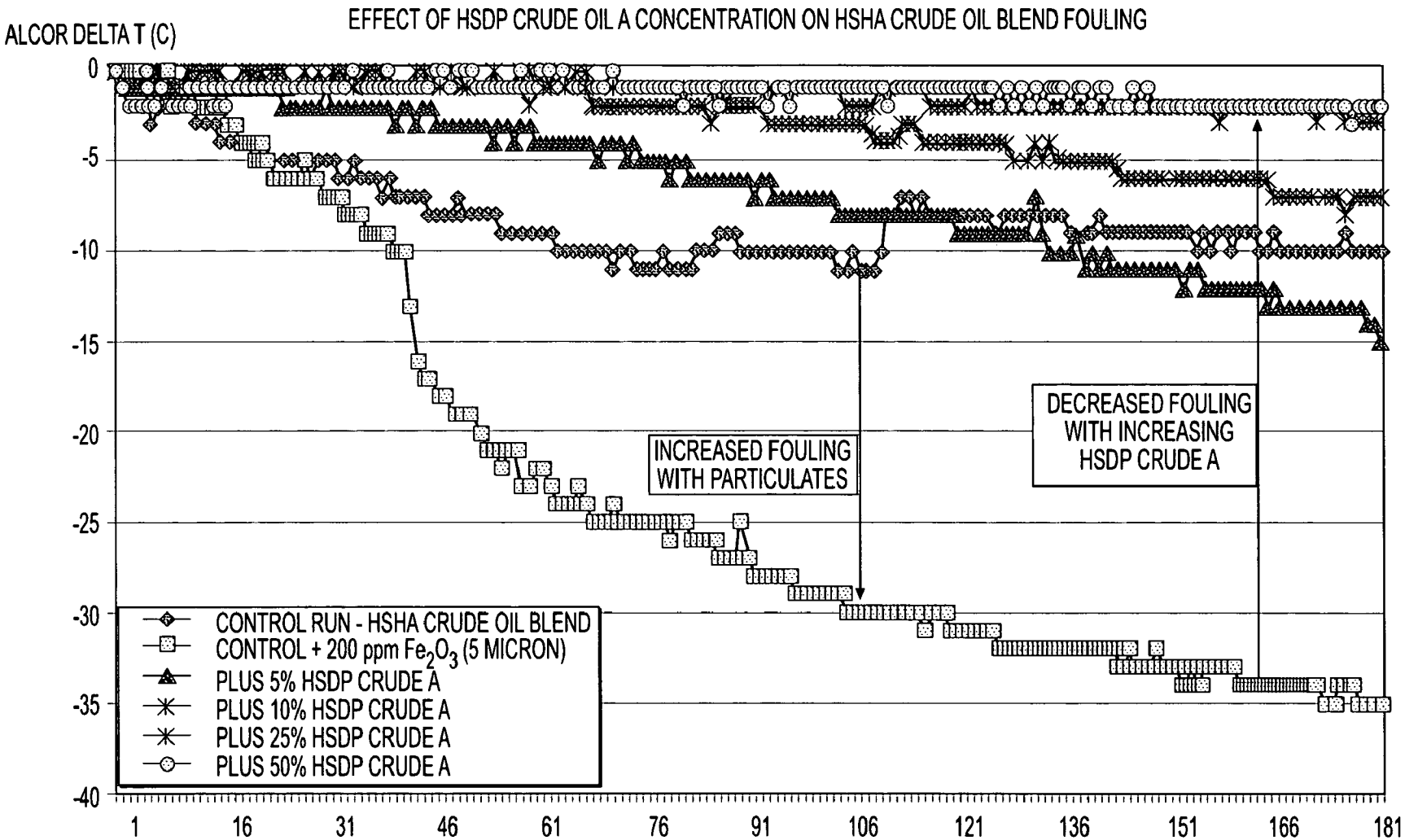
FIG. 5 is a graph illustrating test results showing reduced fouling associated with a HSHA crude oil blend when blended with HSDP Crude Oil A in accordance with this invention.
Figure 6:
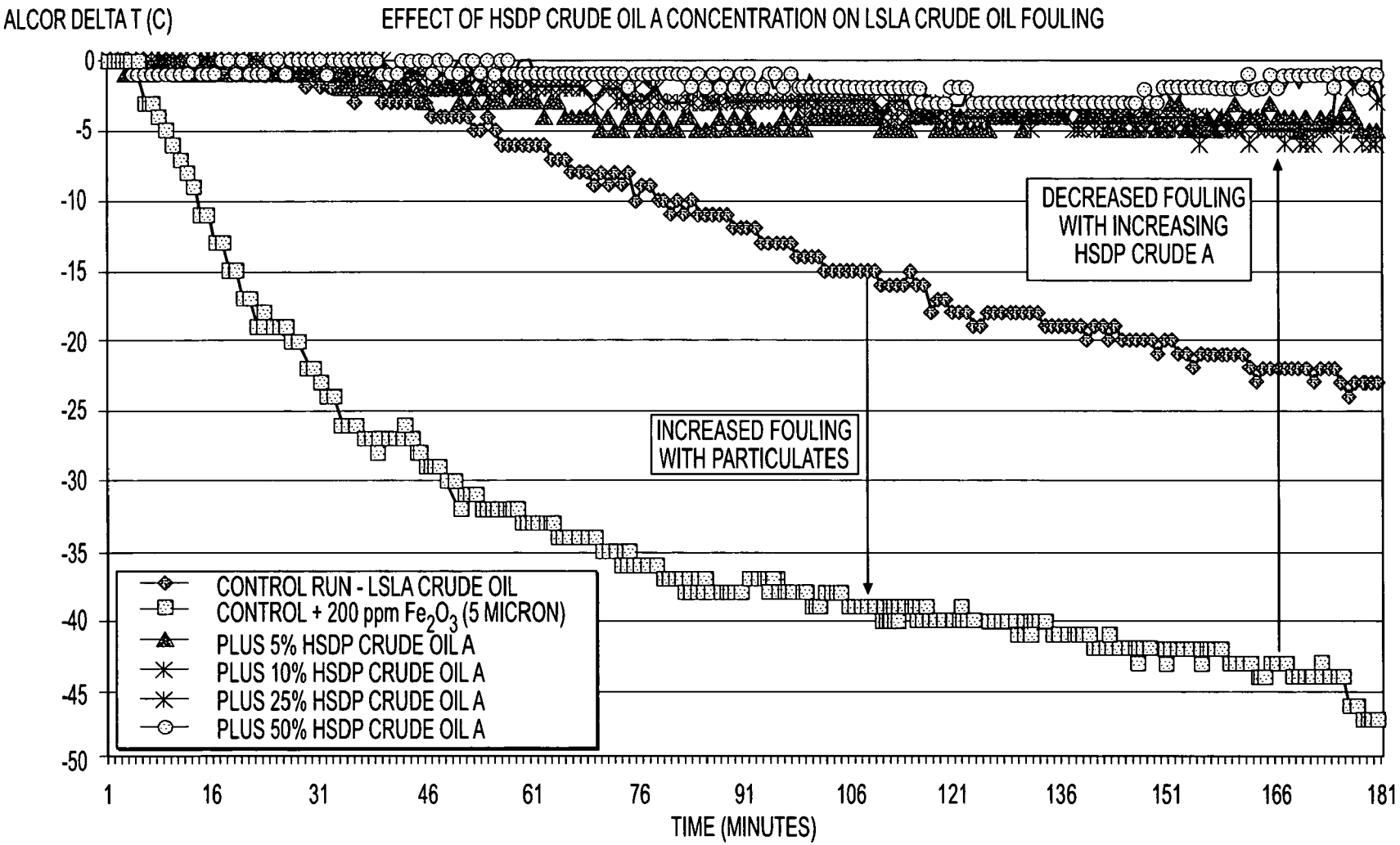
FIG. 6 is a graph illustrating test results showing reduced fouling associated with a LSLA crude oil when blended with HSDP Crude Oil A in accordance with this invention.
Figure 7:
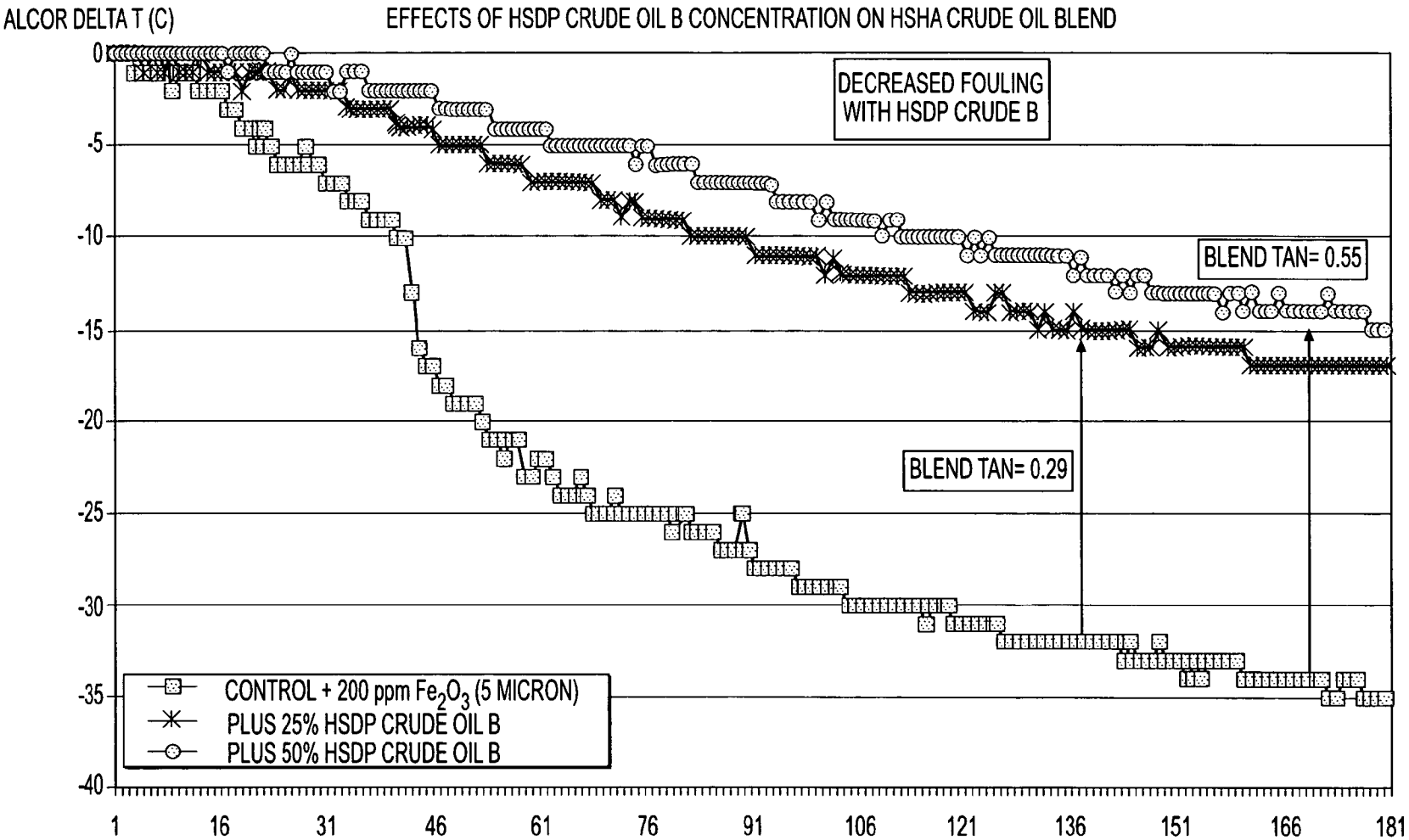
FIG. 7 is a graph illustrating test results showing reduced fouling associated with a HSHA crude oil when blended with HSDP Crude Oil B in accordance with this invention.
Figure 8:
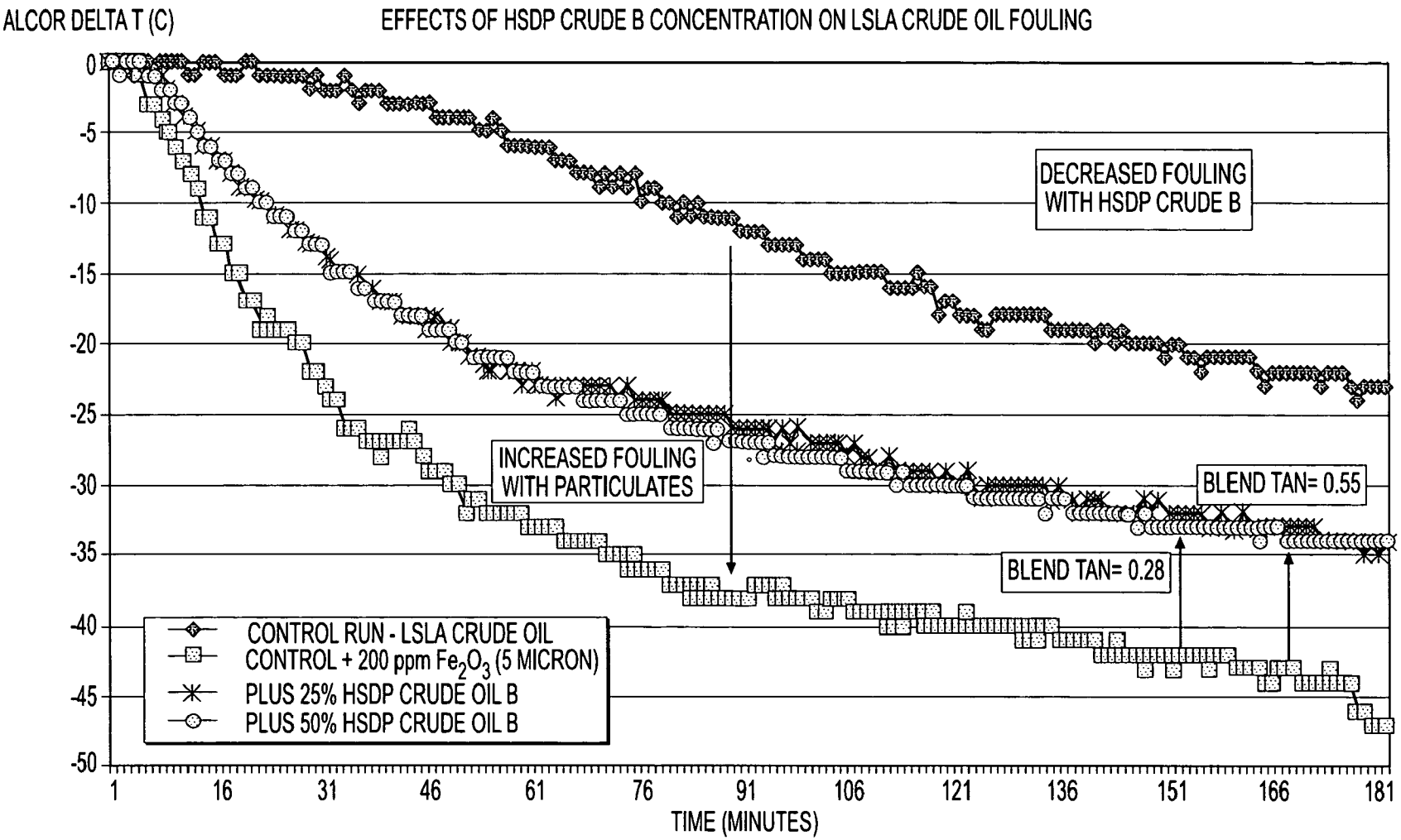
FIG. 8 is a graph illustrating test results showing reduced fouling associated with a LSLA crude oil when blended with HSDP Crude Oil B in accordance with this invention.

Sample tests were also performed to determine the effect the addition of the HSDP Crude Oil A to a base oil containing either LSLA whole crude oil or HSHA blended crude oil has on the fouling of the base oil. The HSDP A crude oil having an approximate TAN of 4.8 and a $S_{BN}$ of 112. The results associated with the impact of the HSDP A on the HSHA blend are illustrated in FIG. 5. The results associated with the impact of the HSDP A on the LSLA whole crude oil are illustrated in FIG. 6. For both base oils, the addition of the HSDP A crude as the HSDP crude oil produced a reduction in fouling.

As shown in FIGS. 5-8, the reduction in fouling increased as the predetermined amount of HSDP crude oil content in the blended crude oil increased.

Figure 9:
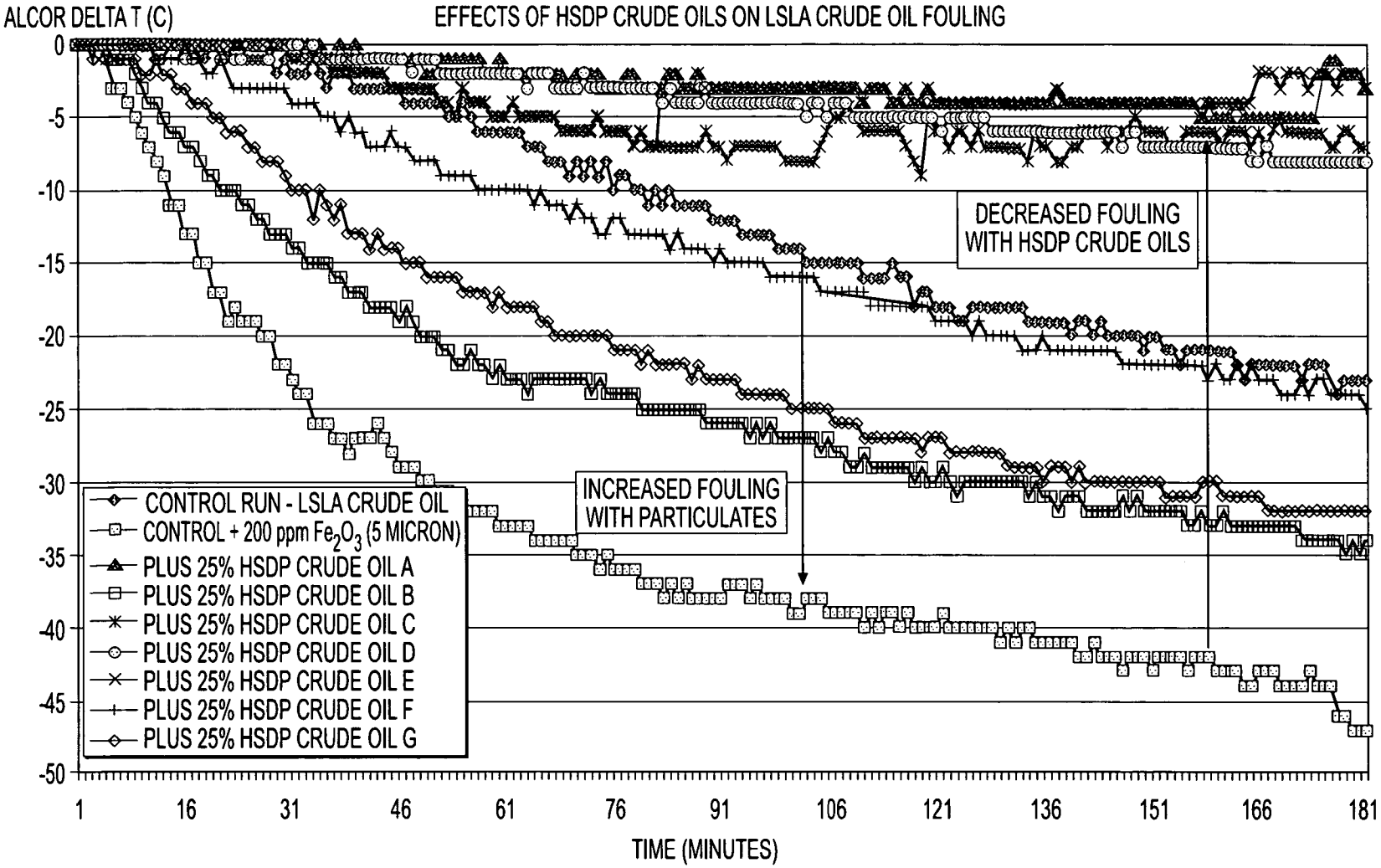
FIG. 9 is a graph illustrating test results showing reduced fouling associated with a LSLA crude oil when blended with a various HSDP Crude Oils (A-G) in accordance with this invention.

The above illustrative examples of the benefits of the present invention were based upon the use of examples A and B crude oils as the HSDP crude oil. The present invention is not intended to be limited to only these examples of HSDP crude oils. Other HSDP crude oils having an approximate TAN of at least 0.3 and a $S_{BN}$ of at least 75 will achieve reductions in fouling. FIG. 9 illustrates the impact beneficial impact on fouling that the addition of various HSDP crude oils on a base oil of LSLA whole crude oil. As summarized in Table 1 below, the addition of HSDP crude oils resulted in a reduction in fouling when compared to base crude oil containing particulates.

TABLE 1

| Crude Mixture | TAN | $S_{BN}$ | ΔT180 |
|---|---|---|---|
| LSLA Crude (control) | — | — | −23 |
| +200 ppm FeO | — | — | −47 |
| +25% HSDP A | 4.8 | 112 | −3 |
| +25% HSDP B | 1.6 | 115 | −34 |
| +25% HSDP C | 1.6 | 158/127 | −7 |
| +25% HSDP D | 1.7 | 93 | −8 |
| +25% HSDP E | 0.6 | 120/132 | −3 |
| +25% HSDP F | 2.5 | 76 | −25 |
| +25% HSDP G | 2.8 | 112 | −32 |

It will be apparent to those skilled in the art that various modifications and/or variations may be made without departing from the scope of the present invention. It is intended that all matter contained in the accompanying specification shall be interpreted as illustrative only and not in a limiting sense. While the present invention has been described in the context of the heat exchanger in a refinery operation, the present invention is not intended to be so limited; rather it is contemplated that the present invention is suitable for reducing and/or mitigating fouling in other refinery components including but not limited to pipestills, cokers, visbreakers and the like. Furthermore, it is contemplated that the use of a HSDP crude oil, as described in connection with the present invention, may be combined with other techniques for reducing and/or mitigating fouling. Such techniques include, but are not limited to, (i) the provision of low energy surfaces and modified steel surfaces in heat exchanger tubes, as described in U.S. patent application Ser. Nos. 11/436,602 and 11/436,802, the disclosures of which are incorporated herein specifically by reference, (ii) the use of controlled mechanical vibration, as described in U.S. patent application Ser. No. 11/436,802, the disclosure of which is incorporated herein specifically by reference (iii) the use of fluid pulsation and/or vibration, which may be combined with surface coatings, as described in U.S. Provisional Patent Application No. 60/815,845, filed on Jun. 23, 2006, entitled "Reduction of Fouling in Heat Exchangers," the disclosure of which is incorporated herein specifically by reference (iv) the use of electropolishing on heat exchanger tubes and/or surface coatings and/or modifications, as described in U.S. Provisional Patent Application No. 60/751,985, the disclosure of which is incorporated herein specifically by reference and (v) combinations of the same, as described in U.S. Provisional Patent Application No. 60/815,844, filed on Jun. 23, 2006, entitled "A Method of Reducing Heat Exchanger Fouling in a Refinery," the disclosure of which is incorporated herein specifically by reference. Thus, it is intended that the present invention covers the modifications and variations of the method herein, provided they come within the scope of the appended claims and their equivalents.

What is claimed is:

1. A method for reducing particulate and asphaltene fouling in a heat exchanger for heating crude oil, comprising:

providing a base crude oil; and blending the base crude oil with a predetermined amount of a high solvency dispersive power (HSDP) crude oil to produce a blended crude oil, wherein the HSDP crude oil having a total acid number (TAN) of at least 0.3, wherein the HSDP crude oil having solubility blending number ($S_{BN}$) of at least 100, wherein the blended base crude oil and HSDP crude oil having a total volume whereby the predetermined amount of the HSDP crude oil is at least 5 percent of the total volume of the blended base crude oil and HSDP crude oil.

2. The method according to claim 1, wherein the predetermined amount is equal to at least ten percent of the total volume of the blended base crude and HSDP crude oil.

3. The method according to claim 2, wherein the predetermined amount is equal to at least twenty five percent of the total volume of the blended base crude and HSDP crude oil.

4. The method according to claim 1, wherein the predetermined amount is equal to at most fifty percent of the total volume of the blended base crude and HSDP crude oil.

5. The method according to claim 1, wherein the HSDP crude oil having a TAN of at least 2.

6. The method according to claim 5, wherein the HSDP crude oil having a TAN of at least 3.

7. The method according to claim 6, wherein the HSDP crude oil having a TAN of at least 4.

8. The method according to claim 1, wherein the base crude oil is one of a whole crude oil and a blend of at least two crude oils.

* * * * *